343-700 MS AU 256 EX
4/21/81 OR 4,263,598

United States Patent [19]
Bellee et al.

[11] 4,263,598
[45] Apr. 21, 1981

[54] DUAL POLARIZED IMAGE ANTENNA

[75] Inventors: Ernest C. Bellee, Scottsdale; Raymond G. Immell, Mesa; Bill H. Sasser, Phoenix, all of Ariz.

[73] Assignee: Motorola, Inc., Schaumburg, Ill.

[21] Appl. No.: 962,815

[22] Filed: Nov. 22, 1978

[51] Int. Cl.[3] ..... H01Q 13/10; H01Q 15/00
[52] U.S. Cl. ..... 343/700 MS; 343/770; 343/836
[58] Field of Search ..... 343/768, 770, 771, 700 MS, 343/836, 909

[56] References Cited

U.S. PATENT DOCUMENTS

| | | | |
|---|---|---|---|
| 3,623,111 | 11/1971 | Provencher et al. | 343/727 |
| 3,691,563 | 9/1972 | Shelton | 343/771 |
| 3,742,513 | 6/1973 | Ehrenspeck | 343/837 |
| 3,990,078 | 11/1976 | Bellee et al. | 343/836 |
| 4,074,270 | 2/1978 | Kaloi | 343/700 MS |
| 4,089,003 | 5/1978 | Conroy | 343/700 MS |
| 4,131,892 | 12/1978 | Munson et al. | 343/700 MS |
| 4,150,383 | 4/1979 | Andersson et al. | 343/771 |

OTHER PUBLICATIONS

Trentini, G. V., "Partially Reflecting Sheet Arrays" in IRE Trans on ANT & Prop, Oct. 1956, pp. 666–671.

*Primary Examiner*—Eli Lieberman
*Attorney, Agent, or Firm*—Eugene A. Parsons

[57] ABSTRACT

A first disk having radiating elements formed thereon, a second disk having radiating elements formed thereon and overlying the first disk, an electromagnetic energy reflecting disk overlying the second disk and having a first plurality of parallel slots aligned with some of the radiating elements and a second plurality of parallel slots, perpendicular to the first slots, aligned with the remainder of the radiating elements, a nonconducting, spacing layer overlying the reflecting disk and a partially reflecting disk overlying the spacing layer so that the radiating elements form slot sources in the reflecting disk with part of the energy from the slot sources passing through the partially reflecting disk and part being reflected back to the total reflecting disk to form a dual polarized image element antenna array. A second embodiment illustrates different energy radiators.

9 Claims, 7 Drawing Figures

Fig 1
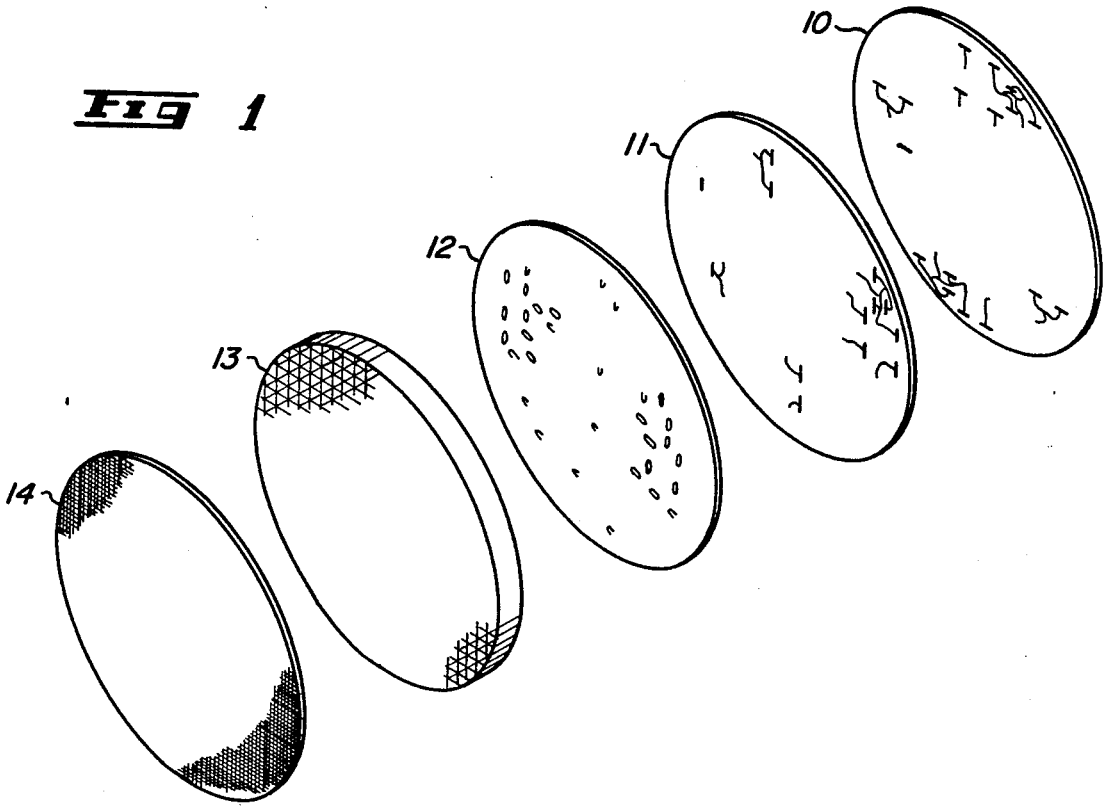
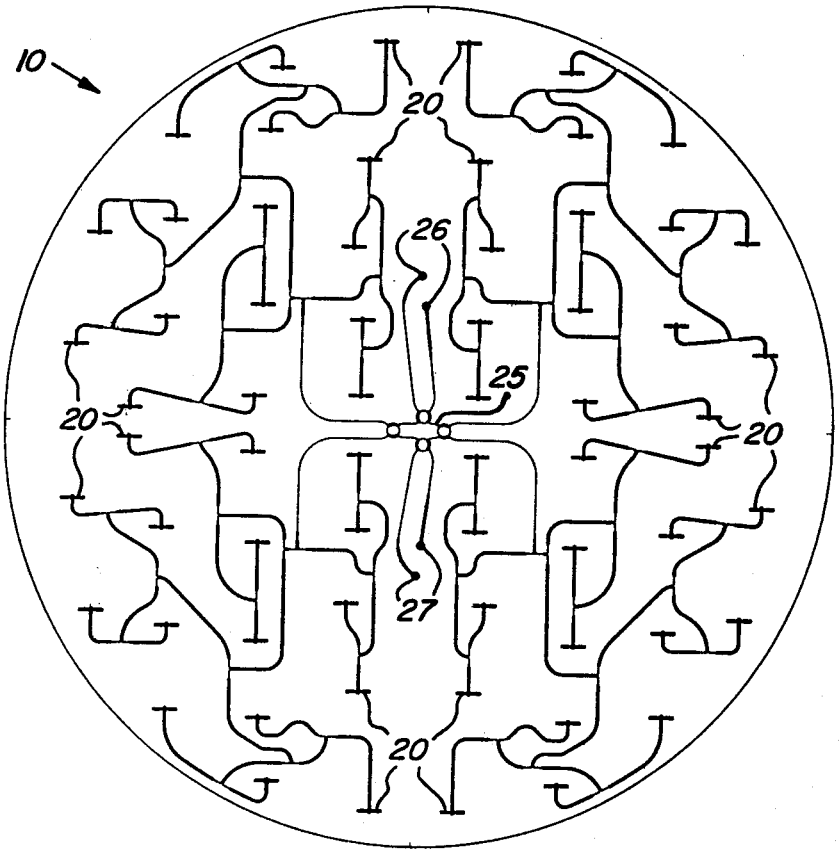
Fig 2

DUAL POLARIZED IMAGE ANTENNA

BACKGROUND OF THE INVENTION

Image element antennas and the operation thereof are described in detail in a paper entitled "Partially Reflecting Sheet Arrays", IRE Transactions On Antennas and Propagation, October 1956, pages 666 through 671. Also, an image element antenna array is described in U.S. Pat. No. 3,990,078, entitled "Image Element Antenna Array For a Monopulse Tracking System For a Missile", issued Nov. 2, 1976 and assigned to the same assignee.

The above described patent discloses a multi-element antenna array and coupling apparatus for connecting power to and taking power from the array. However, a single frequency antenna is disclosed and, in many applications it is desirable to reuse the same frequency or to utilize a different frequency. Generally such frequency reuse is severely limited or prohibited by high mutual coupling and pattern degradation.

SUMMARY OF THE INVENTION

The present invention pertains to a dual polarized image antenna array including a first plurality of means for radiating and receiving electromagnetic energy, a second plurality of means, polarized perpendicular to said first plurality, reflecting means forming a plane for totally reflecting said electromagnetic energy from said radiating means, said radiating means being positioned in the plane of the reflecting means, and partially transmitting and reflecting means spaced from said total reflecting means and parallel thereto for substantially reflecting and transmitting the electromagnetic energy from said radiating means. The antenna array utilizes the aperture thinning resulting from the image approach to insert additional elements to achieve frequency or aperture reuse. Cross polarized elements allow frequency reuse or can be operated at a different frequency and smply share the aperture.

It is an object of the present invention to provide a new and improved dual polarized image antenna array.

It is a further object of the present invention to provide a new and improved dual polarized image antenna array which provides frequency reuse without high mutual coupling and pattern degradation, or operation at two different frequencies.

It is a further object of the present invention to provide a dual polarized image antenna array which is relatively simple and inexpensive to construct and which is small and compact.

These and other objects of this invention will become apparent to those skilled in the art upon consideration of the accompanying specification, claims and drawings.

BRIEF DESCRIPTION OF THE DRAWINGS

Referring to the drawings, wherein like characters indicate like parts throughout the Figures:

FIG. 1 is an exploded view in perspective of the various components of an image antenna array incorporating the present invention;

FIG. 2 is an enlarged view in front plan of a portion of the apparatus of FIG. 1;

DESCRIPTION OF THE PREFERRED EMBODIMENT

Figure 3:
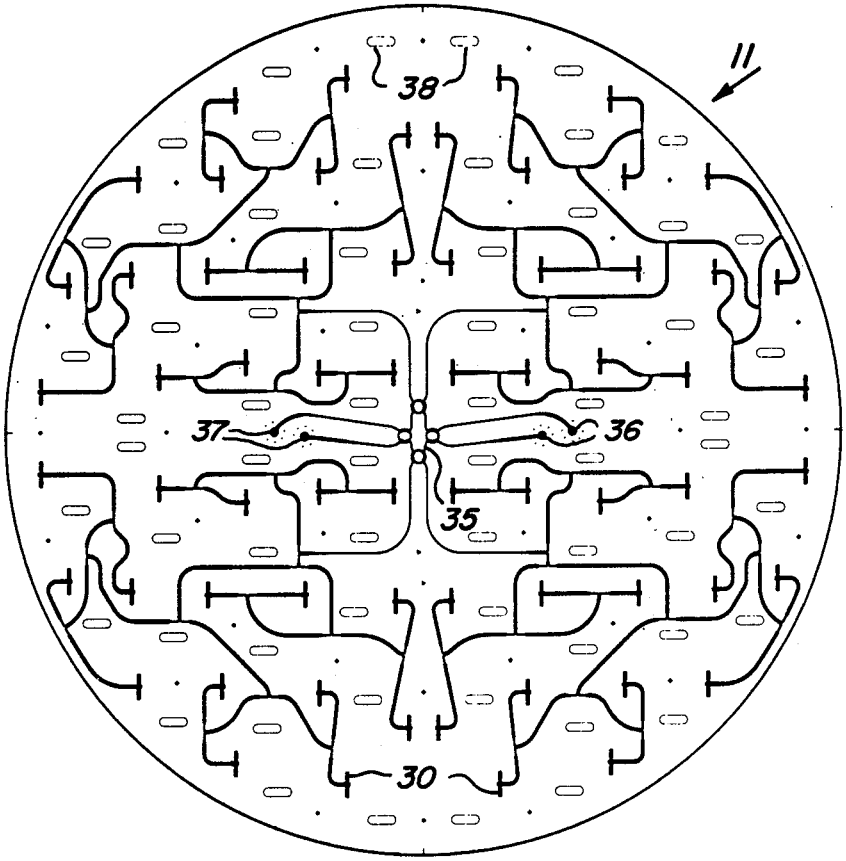
FIG. 3 is an enlarged view in front plan of a second portion of the apparatus of FIG. 1.

Referring specifically to FIG. 1, an exploded view in perspective of the various components of a dual polarized image antenna array is illustrated. The components include a first flat disk or plate 10, a second disk 11, a third disk 12, a circular spacing element 13 and a final disk 14. The disks 10, 11 and 12 are illustrated in detail in FIGS. 2, 3 and 4, respectively, and will be described in conjunction therewith. It should be understood that circular disks are illustrated for the various components, but other configurations, including the combination of elements onto a single disk and the use of other than a circular configuration, may be devised by those skilled in the art. Further, the components 10 through 14 must be tightly laminated together so as to prevent relative movement therebetween and this lamination may be achieved in any convenient manner, such as by bonding each of the components to the adjacent component or by holding the entire assembly in some type of mounting bracket.

FIG. 2 is an enlarged view in front plan of the component 10. The disk or plate 10 is formed of a thin nonconducting material with a plurality of radiating elements 20 formed on one side thereof. Each of the radiating elements 20 is formed as an elongated section of conductor, such as copper or the like, and all of the sections are parallel. In the embodiment illustrated in FIG. 2 sixty-four elements 20 are distributed on the disk 10. The sixty-four elements 20 are distributed on the disk 10 to provide a desired antenna pattern. All of the elements 20 are connected together by conducting leads, of copper or the like, deposited or otherwise formed on the surface of the disk 10 and all of the elements are ultimately connected to a feed network 25. Also connected to the feed network 25 are two pairs of input/output terminals 26 and 27. The operation of the feed network 25 is fully disclosed in the above referenced U.S. Pat. No. 3,990,078, and will not be disclosed in detail herein. Electrical signals applied to the input/output terminals 26 and 27 energize all sixty-four radiating elements 20 and electromagnetic energy received by the radiating elements 20 is conducted to the appropriate input/output terminals 26 and 27.

Referring to FIG. 3, a view in front plan of the component 11 is illustrated. For convenience, in this embodiment, the component 11 is constructed similar to the component 10 with sixty-four radiating elements 30, a feed network 35, two input/output terminals 36 and 37. All of these parts are positioned and operate the same as the similar parts of disk 10. The major difference between the components 10 and 11 is that the disk 11 is rotated 90° relative to the disk 10 so that the radiating elements 30 are perpendicular to the radiating elements 20. Further, with the rotation of the disk 11 all of the radiating elements 30 are spaced from the radiating elements 20 so that there is no interference therebetween. A plurality of slots 38 are formed in the disk 11 in register with the radiating elements 20 of the disk 10 (when the disks 10 and 11 are positioned in the correct parallel overlying relationship) so that no interference with the radiation or reception of the radiating elements 20 is produced by the disk 11. It should be understood that the disk 11 might be constructed of material which would not require an opening 38 therethrough, if desired. In the present embodiment the disks 10 and 11 are formed similar to printed circuit boards, e.g., copper clad Teflon fiberglass or any of the other great variety of materials and methods known to those skilled in the art. By forming the disks 10 and 11 exactly the same, a substantial reduction in the cost of manufacture (standardization) can be realized. However, it should be understood that constructing disks 10 and 11 the same is only one embodiment and many other configurations and modifications may be devised by those skilled in the art.

Figure 4:
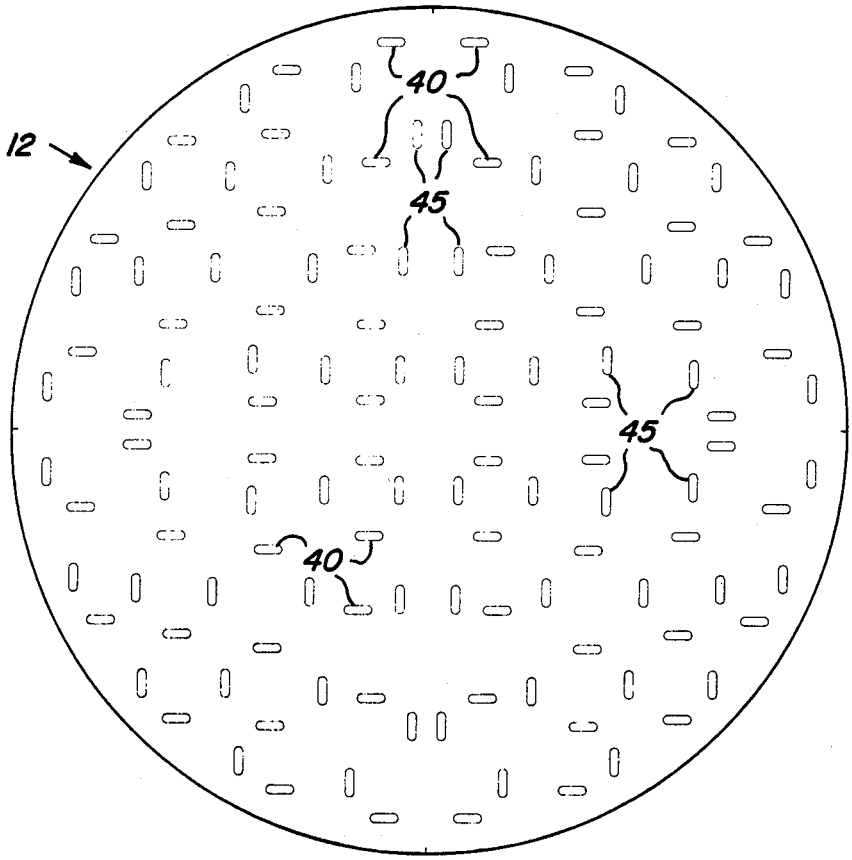
FIG. 4 is an enlarged view in front plan illustrating a total reflecting plate positioned in mating cooperation with the components illustrated in FIGS. 2 and 3.
Figure 5:
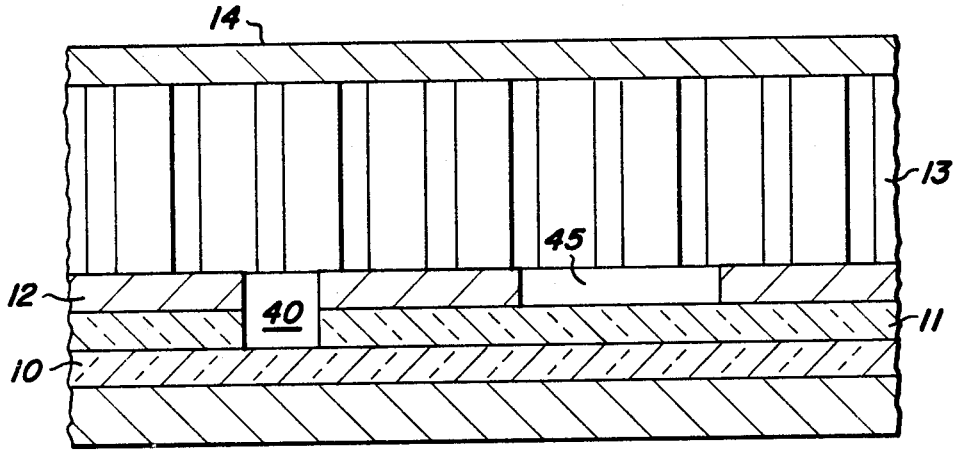
FIG. 5 is a cross sectional view of a portion of an assembled unit including the components of FIG. 1.

FIG. 4 illustrates the disk 12 in front plan. Disk 12 is formed of a material which totally reflects the electromagnetic energy radiated by elements 20 and 30. Such material may be, for example, any material which conducts electricity, such as copper, aluminum, etc. The disk 12 should be constructed with a thin layer of insulation on the side adjacent the disk 11 to prevent shorting of the elements 30 or the leads connected thereto. A first plurality of parallel slots 40 are formed through the disk 12 so as to be in register with the radiating elements 20 of the disk 10 and the slots 38 in the disk 11. A second plurality of parallel slots 45 are formed through the disk 12 and positioned in register with the radiating elements 30 of the disk 11, when the disks 10, 11 and 12 are positioned in the correct parallel overlying relationship. The combination of the slots 40 and the radiating elements 20 form a first plurality of slot sources which radiate or receive electromagnetic energy, as described in the above referenced patent. The combination of the slots 45 and the radiating elements 30 form a second plurality of slot sources which also radiate and/or receive electromagnetic energy. The small increase in phase delay which results from the positioning of the disk 10 behind the disk 11 is compensated for by a small additional line length in the circuit of the disk 11 such that a linearly polarized signal will be received in phase at the outputs of the two pluralities of elements.

The spacing component 13, illustrated in FIG. 1, is constructed of a dielectric material which will not affect the pattern of the antenna and is formed in the shape of a honeycomb to provide the required ruggedness. The fifth component, disk 14, is a partially reflecting disk for partially reflecting and partially transmitting energy radiated by the slot sources. The disk 14 may be constructed of a dielectric material which may be, for example, nickel-aluminum-titanate, or the like, or it may be a reactive grid, such as that described in the copending application filed Nov. 22, 1978, Ser. No. 962,814, and entitled "Reactive Surface for Image Antenna". The combination of the total reflecting components 12 and the partial reflecting component 14 spaced therefrom cooperate to provide the image concept to the antenna array. The honeycomb shaped component 13 is a simplified structure for providing the required spacing and for maintaining the spacing constant throughout the entire adjacent surfaces of the disks 12 and 14. Further, while substantially any partially reflecting material may be utilized for the disk 14, the use of nickel-aluminum-titanate has been found to greatly improve the operation of the image antenna array if a dielectric material is used, but the reactive grid is believed superior in operation and construction.

Figure 6:
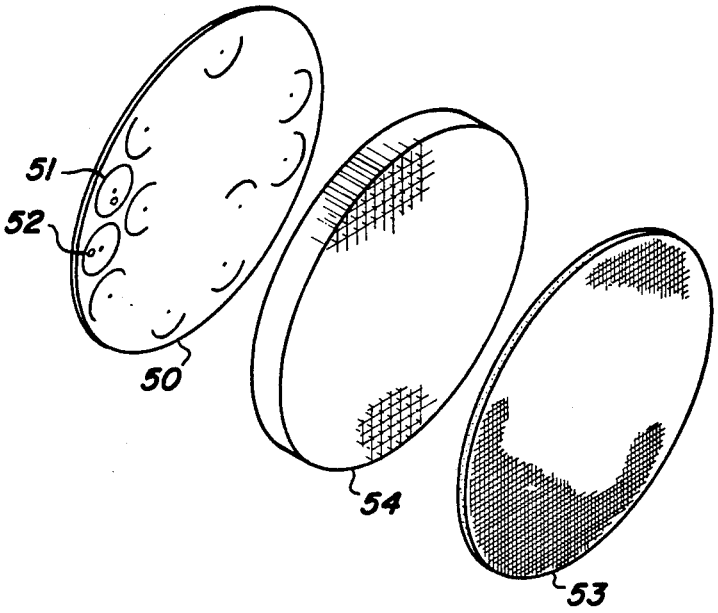
FIG. 6 is an exploded view similar to FIG. 1 of another embodiment.
Figure 7:
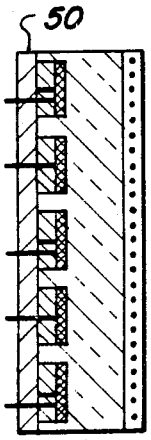
FIG. 7 is a cross sectional view of a portion of an assembled unit including the components of FIG. 6.

While the embodiment of FIGS. 1–5 utilize image elements and slot sources to provide radiation from a source in the plain of the totally reflecting disk, it should be understood that substantially any radiating element might be utilized. For example microstrip antennas, such as those described in U.S. Pat. No. 4,089,003, entitled "Multifrequency Microstrip Antenna" and issued May 9, 1978 (including the patented structure and prior art referred to) might be utilized. These antennas can be polarized in orthogonal planes and can be linear or circularly polarized. FIGS. 6 and 7 illustrate one embodiment where orthogonally polarized microstrip antennas are utilized. A totally reflecting disk 50 serves as the ground plane for pluralities of microstrip antennas 51 and 52 each of which includes a radiating disk fed at a point which produces vertical or horizontal (as illustrated in FIG. 6) polarization, respectively. The various feed points are connected together by means, not shown, which may be similar to the networks illustrated in conjunction with the first embodiment, or may simply be a plurality of leads connected in parallel to input/output terminals. A disk 53 is a reactive grid which partially reflects and partially transmits radiated energy. The disk 54 is a honeycomb spacer similar to the disk 13 described in conjunction with the previous embodiment. FIG. 7 illustrates the microstrip antennas in an assembled image antenna array. Because the energy radiator can be formed in any of a variety of embodiments, including those described, these radiators will be referred to as "radiating means" and this term should be understood to include any apparatus that will perform the functions described and which comes within the scope of the invention.

Because of the image concept in the present antenna and the dual polarization, radiation from the radiating means providing a first polarized signal has substantially no effect on radiation from the radiating means providing the second polarized signal. Because of this low mutual coupling and minimal pattern degradation, the cross polarized radiating means allow frequency reuse or the two pluralities of radiating means can be operated at different frequencies and simply share the same aperture. Thus, an improved dual polarized image antenna array is disclosed which can provide dual polarization and frequency reuse without the high mutual coupling and pattern degradation normally experienced in prior art arrays. Further, the present image antenna array can be simple to construct, because of the use of standardized components 10 and 11 and because of the simplified spacing element, and is relatively inexpensive. Further, the improved spacing element improves the reliability and ruggedness of the antenna array and the positioning of the radiating means greatly reduces the size.

While we have shown and described a specific embodiment of this invention, further modifications and improvements will occur to those skilled in the art. We desire it to be understood, therefore, that this invention is not limited to the particular form shown and we intend in the appended claims to cover all modifications which do not depart from the spirit and scope of this invention.

What is claimed is:

1. A dual polarized image antenna array comprising:

(a) A first plurality of radiating means for radiating and receiving electromagnetic energy, each radiating means of said first plurality being oriented with the polarizations thereof parallel;

(b) a second plurality of radiating means spaced from said first plurality of radiating means for radiating and receiving electromagnetic energy, each radiating means of said second plurality being oriented with the polarization thereof parallel and perpendicular to the polarization of said first plurality of radiating means and each of said first and second pluralities of radiating means operating at approximately the same frequency;

(c) reflecting means forming a plane for totally reflecting electromagnetic energy radiated by said radiating means;

(d) partially transmitting and reflecting means mounted in spaced relation and substantially parallel to the plane formed by said reflecting means for partially reflecting and transmitting the electromagnetic energy from said radiating means; and (e) feed means for supplying energy of the correct phase to said radiating means to be transmitted thereby and for providing an output for energy received by said radiating means.

2. A dual polarized image antenna array as claimed in claim 1 wherein the first and second pluralities of radiating means include first and second pluralities of slot source means including first means mounting a plurality of elements generally in a first common plane, second means mounting a plurality of elements generally in a second common plane parallel with and in juxtaposition to said first plane, and said pluralities of elements being coupled to the feed means for radiating and receiving electromagnetic energy, and the reflecting means includes a plate of conductive material positioned parallel with the first and second common planes and having a first plurality of slots oriented parallel and in overlying relationship to a portion of the elements and a second plurality of slots oriented parallel, perpendicular to said first plurality of slots and in overlying relationship to the remainder of the elements.

3. A dual polarized image antenna array as claimed in claim 2 wherein the first and second means each include a section of printed circuit board.

4. A dual polarized image antenna array as claimed in claim 1 wherein the partially transmitting and reflecting means includes a plate of nickel aluminum titanate.

5. A dual polarized image antenna array as claimed in claim 1 wherein the partially transmitting and reflecting means includes a reactive grid.

6. A dual polarized image antenna array as claimed in claim 1 wherein the reflecting means and the partially transmitting and reflecting means are mounted in parallel spaced apart relationship by a section of nonconducting material formed in the shape of a honeycomb and affixed to adjacent surfaces thereof.

7. A dual polarized image antenna array as claimed in claim 1 wherein the first and second pluralities of radiating means include microstrip antennas.

8. A dual polarized image antenna array comprising:

(a) a first generally plate shaped member having a first plurality of radiating elements formed thereon for radiating and receiving electromagnetic energy;

(b) a second generally plate shaped member having a second plurality of radiating elements formed thereon for radiating electromagnetic energy, said second member being positioned in parallel juxtaposition to said first member with the radiating elements spaced apart;

(c) a reflecting plate shaped member formed of conductive material and positioned in parallel juxtaposition to said second member, said reflecting plate having a first plurality of parallel slots formed therethrough in overlying relation to a portion of said radiating elements so as to cooperate therewith to form slot sources and a second plurality of parallel slots formed therethrough in overlying relation to the remainder of said radiating elements so as to cooperate therewith to form slot sources, said first plurality of slots being oriented perpendicular to said second plurality of slots and said first and second pluralities of slot sources operating at approximately the same frequency;

(d) a partially transmitting and reflecting dielectric plate mounted in spaced relation and parallel to said reflecting plate for partially reflecting and transmitting the electromagnetic energy from said slot sources; and (e) feed means coupled to said radiating elements for supplying energy of the correct phase to said slot sources to be transmitted thereby and for providing an output for energy received by said slot sources.

9. A dual polarized image antenna array as claimed in claim 8 including a layer of dielectric material positioned between the reflecting plate and the partially transmitting and reflecting plate for providing the spacing therebetween, the first plate member, second plate member, reflecting plate, dielectric layer and partially transmitting and reflecting plate being held in a tightly laminated unit.

* * * * *